United States Patent [19]

Handfield

[11] Patent Number: 4,730,991

[45] Date of Patent: Mar. 15, 1988

[54] GAS ACTUATED PROPORTIONING PUMP

[75] Inventor: Gerard J. Handfield, Edmonton, Canada

[73] Assignee: James M. Greentree, Edmonton, Canada

[21] Appl. No.: 890,395

[22] Filed: Jul. 29, 1986

[51] Int. Cl.[4] ..... F04B 35/00

[52] U.S. Cl. ..... 417/397

[58] Field of Search ..... 417/397

[56] References Cited

U.S. PATENT DOCUMENTS 3,070,023 12/1962 Glasgow ..... 417/397

4,653,986 3/1987 Ashton ..... 417/397 X

FOREIGN PATENT DOCUMENTS 2406096 6/1979 France ..... 417/397

1394648 5/1975 United Kingdom ..... 417/397

*Primary Examiner*—Leonard E. Smith

*Attorney, Agent, or Firm*—Fleit, Jacobson, Cohn & Price

[57] ABSTRACT

A gas pressure operated proportioning pump is provided including axially aligned and spaced opposed end pumping cylinders and an intermediate drive cylinder provided with centrally apertured opposite end cylinder heads. A piston is reciprocal in the drive cylinder and includes oppositely axially projecting diametrically reduced pumping pistons extending and reciprocal through the cylinder heads in sliding sealed engagement therewith and projecting into the adjacent ends of the pumping cylinders. The pumping cylinder adjacent ends include seal structure slidingly and sealingly engaged with the pumping pistons and the remote ends of the pumping cylinders include check valve equipped fluid inlet and outlet ports. Fluid pressure and supply discharge structure is included for inversely supplying and discharging drive fluid to and from the opposite ends of the drive cylinder and alternating the drive cylinder ends to and from which drive fluid is supplied and discharged in sequence with reciprocation of the drive piston.

6 Claims, 4 Drawing Figures

GAS ACTUATED PROPORTIONING PUMP

BACKGROUND OF THE INVENTION

1. Field of the Invention

This invention relates to an improved pneumatically actuated proportioning pump and more specifically to a pump to be used in the petroleum industry in a dehydrator system for natural gas.

There are a variety of pneumatically actuated pumps that are either single acting or double acting, with the capacity to pump a variety of fluids and semi-fluids. In such pumps there is incorporated a reciprocating drive piston in a chamber that is connected axially to a pumping piston in a different chamber. The reciprocation of the drive piston and the pumping piston is controlled by a control valve that is actuated by the positon of the drive piston or the pumping piston. The driving and pumping chambers can be attached in a common main body, or can be separate chambers that are mechanically connected by a piston connecting rod.

Pumps of this type having positive displacement cylinders with reciprocating pistons are for the most part driven by a pressurized gaseous medium that is either exhausted to the atmosphere or to a waste sink. In particular, the proportioning pump that is used in a dehydrator system uses natural gas as the driving medium and the natural gas is exhausted to the atmosphere. The natural gas which is exhausted to the atmosphere by present proportioning pumps cannot be economically recovered and is thus wasted by the dehydrator system.

In the current technology of the proportioning pumps, the discharge pressure of the displacement medium in the drive cylinder must be at atmosphere pressure. Superatmospheric pressure conditions on the discharge causes the pump to stall or to become less efficient in a direct ratio to the increase in the back pressure on the discharge.

The pumps which are gas pressure actuated, either single or double acting, usually are provided with interconnecting reciprocating actuating and pumping pistons both being accommodated in their own chambers and with the actuating or driving piston having a larger cross-sectional area than the pumping piston. The mechanism of pumping with this configuration only can be accomplishd by a valving system that allows the medium being pumped to enter into the pumping chamber during a suction stroke of the pumping piston. The suction stroke of the pump can be accomplished either by means of the plurality of actuating and pumping pistons or by means of a helical spring that returns the actuating piston to the normally stable position. The valving system that is open on the suction stroke is normally closed on the pumping stroke. The discharge ports of these pumps have valving systems that operate opposite to the suction valve. The valve on the discharge port is normally closed during the suction stroke of the pumping piston and is opened by the medium being pumped during the pumping stroke of the piston.

The above described valving system is an integral part of the pump and must be fixed securely to the pump by a threaded or clamping device. This assembly of valve has a disadvantage that the pump discharge or suction must be disassembled in order to maintain a malfunctioning valve. A further disadvantage is to be seen in the fact that the valving mechanism must be designed and manufactured specifically for each pump configuration.

The prior construction of a high pressure pneumatically actuated reciprocating proportioning pump required careful design sealing rings or glands between the drive chamber and the pumping chamber. The sealing mechanism only could be manufactured with careful precision on special machines.

2. Description of Related Art

Various different forms of proportioning and other pumps including some of the general structural and operational features of the instant invention are disclosed in U.S. Pat. Nos. 2,858,162, 3,201,031, 3,825,122, 4,104,008, 4,119,113, 4,390,322 and Re.25,873.

However, these previously known forms of proportioning and other similarly constructed pumps usually require excessive pump disassembly in order to repair or replace a valve and further require excessive precision machining and sealing.

SUMMARY OF THE INVENTION

It is the general object of the present invention to avoid the disadvantage of the prior art by providing a pressurized gas actuated proportioning pump that is simple in construction, uses currently available components that have proven reliability and has a configuration that allows for ease of construction and ease of ongoing maintenance.

In addition, a further object is to provide a pressurized gas actuated proportioning pump, for the specific application on a dehydrator system of a natural gas producing well that conserves the drive medium (natural gas). The invention provides for the conservation of natural gas and reduces or eliminates the environmental impact of natural gas being discharged to the atmosphere, which impact occurs in the current state of the art pumping system. The conservation of natural gas is accomplished by the unique application of currently available components, some of which are patented, in a configuration that allows the pressurized gas actuated proportioning pump to operate efficiently with the back pressure on the discharge of the actuating medium. The invention requires only a differential pressure of the actuating medium between the supply sink and the exhaust sink.

Yet another object of the instant invention is to provide a method of sealing the pump chamber in order to eliminate the necessity of precision alignment of the pump chamber and the drive chamber. Precision alignment was previously necessary to assure that the seals or glands on the pumping piston, which is coaxially connected to the drive piston, did not have any excessive radial pressures. Such radial pressures cause excessive wear in the seal mechanism and premature failure of the sealing gland. The invention provides for self-aligning seal chamber that reduces or eliminates radial pressure on the seal gland from the pump piston.

Another object of this invention is to provide check valves on the intake and discharge of the pneumatically actuated proportioning pump that utilizes an existing patented check valve (such as that disclosed in U.S. Pat. No. 2,538,364) in a chamber that provides ease of construction, ease of access to the check valve and ease of removal and replacement of a check valve or the entire pump from the dehydrator system with minimum interruption of the system.

A final object of this invention to be specifically enumerated herein is to provide a proportioning pump in accordance with the preceding objects and which will conform to conventional forms of manufacture, be of simple construction and dependable in operation so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2:
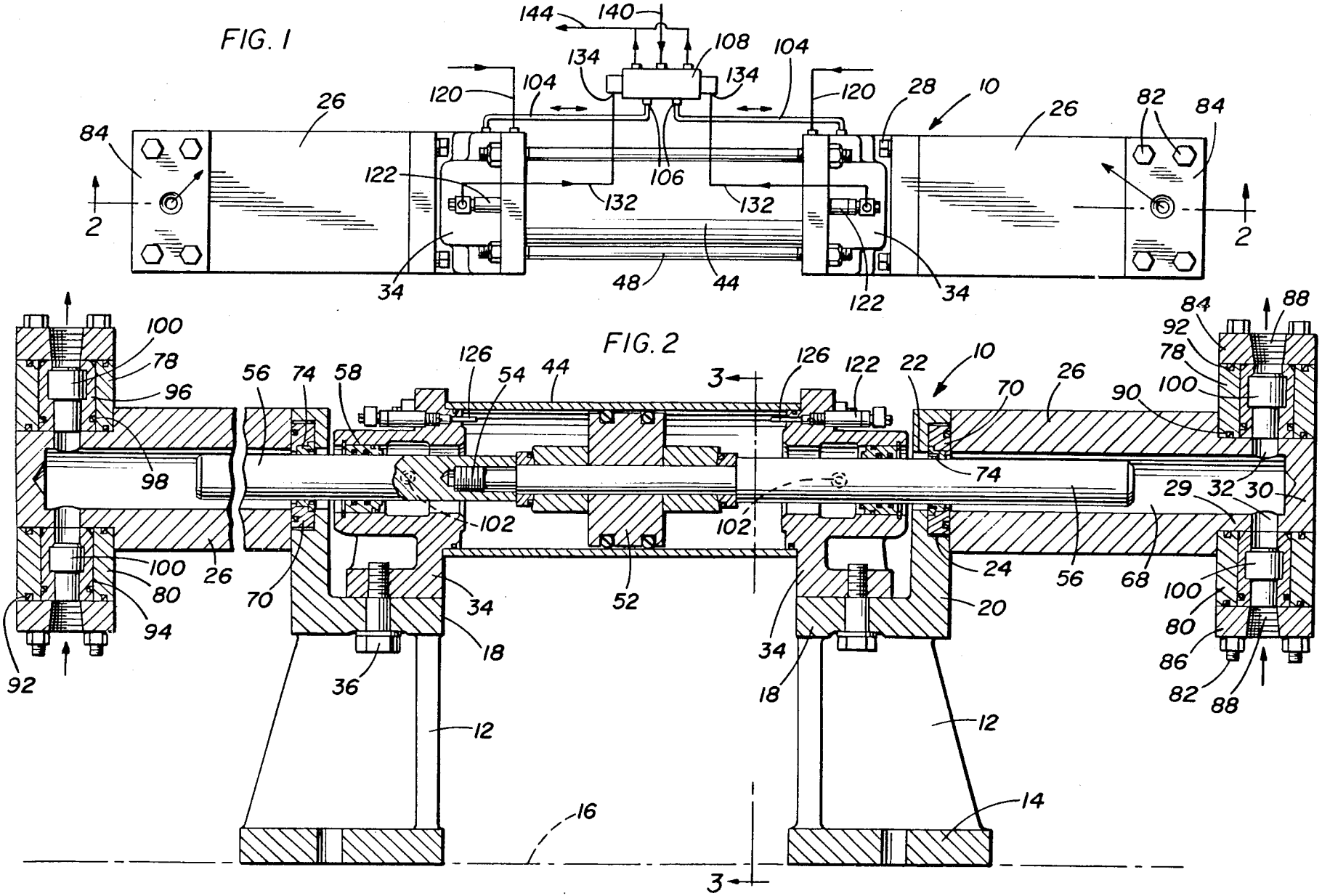
FIG. 1 is a top plan view of the proportioning pump of the instant invention.
FIG. 2 is an enlarged longitudinal vertical sectional view taken substantially upon the plane indicated by the section line 2—2 of FIG. 1.

Referring now more specifically to the drawings, the numeral 10 generally designates the proportioning pump of the instant invention. The pump 10 includes a pair of support stands 12 including mounting bore equipped bases 14 for securement of the stands 12 from a suitable support structure 16. Each of the stands 12 includes an upper horizontal flange 18 and a vertical flange 20 projecting upward from the corresponding flange 18. The flanges 20 are supported from the remote sides of the horizontally spaced apart horizontal flanges 18.

Each vertical flange 20 includes a horizontal bore 22 extending therethrough and the remote ends of the bores 22 include diametrically enlarged counterbores 24. The remote sides of the flanges 20 have adjacent ends of axially aligned pumping cylinders 26 secured thereto by threaded fasteners 28 extending through the flanges 20 and threadedly engaged in the wall of the pumping cylinders 26. The remote ends of the cylinders 26 include rectangular reduced end portions 29 closed at their remote ends by end walls 30 and including opposing bores 32 opening radially into the interior of the corresponding cylinder 26.

The horizontal flanges 18 of the stands 12 mount cylinder heads 34 therefrom through the utilization of removable threaded fasteners 36 and each of the heads includes a central horizontal bore 38 formed therethrough including a diametrically enlarged longitudinal mid-portion 40. The adjacent ends of the heads 34 include opposing and aligned cylindrical bosses 42 supporting opposite ends of a drive cylinder 44 therefrom and the bosses 42 include circumferential O-rings 46 forming a fluid tight seal between the bosses 42 and the interior surfaces of the corresponding ends of the drive cylinder 44. In addition, tension bolts 48 extend between and are threadedly secured through outer peripheral portions of the head 34 whereby the drive cylinder 44 is tightly clamped between the shoulders 50 defined by the diametrically reduced mounting bosses 42.

A drive piston 52 is reciprocal in the drive cylinder 44 and includes diametrically reduced oppositely axially projecting threaded shank portions 54 upon which the adjacent ends of a pair of longitudinally spaced and axially aligned pump pistons 56 are mounted. The pump pistons 56 are loosely received through the bores 38 and are sealingly received through annular seal assemblies 58 removably secured in the cylinder heads 34 by snap rings 60. Each annular seal assembly 58 includes an outer annular seal 62 sealing the assembly 58 to the corresponding bore 38 and an internal seal 64 sealing the assembly 58 relative to the corresponding pump piston 56. In addition, each assembly 58 further includes a wiper seal 66 disposed in sliding wiping engagement with the corresponding pump piston 56.

Each of the pump pistons 56 projects through the corresponding cylinder head 34 and into the corresponding longitudinal blind bore 68 formed in the associated piston cylinder 26 and into which the corresponding radial bores 32 open inwardly. The counterbores 24 include annular seal rings 70 clamped therein and each annual seal ring 70 includes an annular seal 72 forming a fluid tight seal with the corresponding vertical flange 20 and a circumferential inner seal 74 forming a sliding fluid tight seal with the corresponding pump piston 56.

The end portions 29 at the remote end portions of the pump cylinders 26 have pairs of identical upper and lower check valve blocks 78 and 80 secured thereto through the utilization of through bolts 82 secured through the blocks 78 and 80 as well as the end portion 29 and also through retainer covers 84 and 86 overlying and underlying, respectively, the corresponding check valve blocks 78 and 80. Each retainer cover 84 and 86 includes a tapered threaded bore 88 formed therein and each check valve block is sealed relative to the corresponding end portion 29 by an O-ring seal 90 and to the corresponding retainer cover by an O-ring seal 92. Further, each of the check valve blocks 78 and 80 includes a mounting bore 94 formed therethrough coaxial with the corresponding bores 32 and 88 and containing a cylindrical valve retainer 96 therein sealed relative to the bore 94 by an O-ring seal 98. Each of the check valve retainers 96 includes a check valve 100 mounted therein comprising a check valve such as that disclosed in U.S. Pat. No. 2,538,364.

Figure 4:
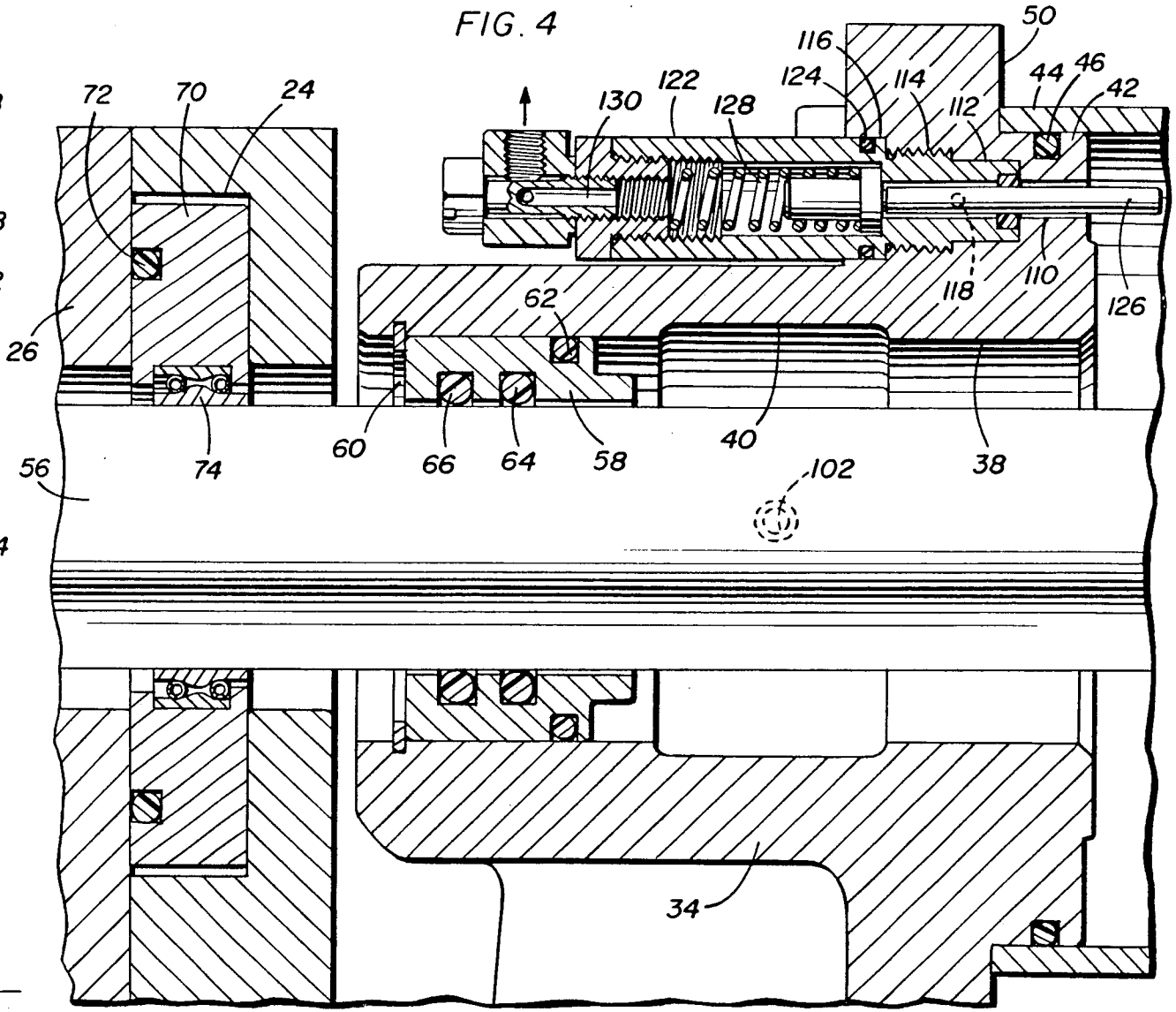
FIG. 4 is a still further enlarged fragmentary vertical sectional view taken substantially upon the plane indicated by the section line 4—4 of FIG. 3.
Figure 3:
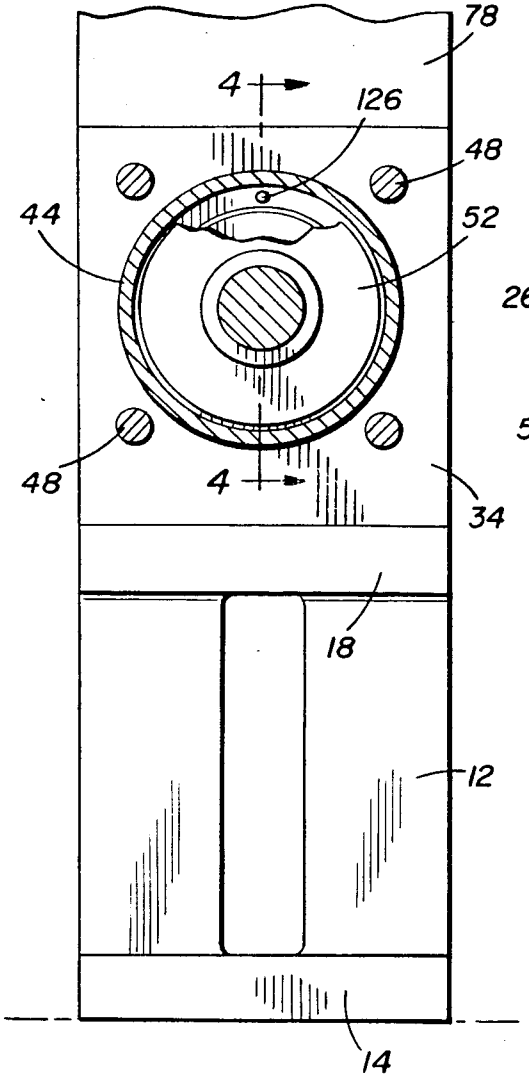
FIG. 3 is a further enlarged transverse vertical sectional view taken substantially upon the place indicated by the section line 3—3 of FIG. 2.

With reference now more specifically to FIG. 4 of the drawings, it may be seen that each annular seal ring 70 enjoys radial clearance relative to the corresponding counterbore 24 and therefore that each annular seal ring 70 may be radially aligned relative to the corresponding pump piston 56. In addition, it may be seen from FIG. 4 that each cylinder head 34 includes a drive gas inlet port 102 to which the discharge end of a gas line 104 is connected, the inlet end of the gas lines 104 being connected to outlet ports 106 of a gas operated valve 108. Further, each cylinder head 34 additionally includes a bore 110 whose inner end opens inwardly into the drive cylinder 44 on the corresponding side of the piston 52 and whose outer end opens outwardly of the cylinder head 34 at its outer end. The outer end of each bore 110 includes first, second and third counterbores 112, 114 and 116 with the counterbores 112 and 116 being smooth and the counterbore 114 being threaded. Further, each cylinder head 34 includes a lateral port 118 opening into the corresponding counterbore 112 at its inner end and having the discharge end of a line 120 connected thereto, the line 120 extending from a supply sink of natural gas, see FIG. 1. Also, a limit switch 122 is mounted in each set of counterbores 112, 114 and 116 and sealed relative to the counterbore 116 by an annular seal 124. Each limit switch 122 includes a spring biased piston assembly 126 projecting through the corresponding bore 110 and engageable by the piston 52. When a piston assembly 126 is engaged by the piston 52 and axially displaced against the corresponding compression spring 128, that limit switch 122 is opened and supply sink gas passes through the port 118 and into the limit switch 122 and is thereafter discharged from the limit switch 122 through the discharge port 130 and discharge line 132. The discharge end of the line 132 opens into the corresponding end of the valve 108 as at 134, the valve 108 comprising a bistable pneumatically operated valve.

Assuming that the various parts of the pump 10 are as illustrated in FIG. 2, the valve 108 has gas supplied thereto through pipe 140. The valve 108 admits gas under pressure into the left-hand cylinder head 34 through the left-hand line 104 illustrated in FIG. 1 and the drive cylinder 44 is therefore pressurized on the left side of the piston 52. The piston 52 moves toward the right causing gas to be discharged through the right-hand line 104 in FIG. 1 from the right-hand end of the drive cylinder 44 and movement of the piston 52 toward the right continues until the piston 52 engages the right-hand piston assembly 126 to open the corresponding limit switch 122 and thereby provide gas under pressure to the valve 108 through the right-hand line 132 in order to reverse the valve. As the piston 52 is moved toward the right as viewed in FIG. 2, gas is discharged from the right-hand end of the drive cylinder 44 through the line 104 and the valve 108 into the discharge line 144.

Upon actuation of the valve 108 by the gas pressure supplied thereto through the right-hand line 132 illustrated in FIG. 2, gas is supplied to the right-hand end of the drive cylinder 44 through the right-hand gas line 104 and is exhausted from the left-hand end of the drive cylinder 44 through the left-hand line 104 and the piston 52 moves toward the left in the drive cylinder 44 until such time as the piston 52 contacts the left-hand piston assembly 126. As the piston 152 and pump pistons 56 are reciprocated back and forth, the fluid to be pumped is drawn in through the lower check valves 100 and exhausted from the upper check valves 100 illustrated in FIG. 2.

The exterior surfaces of the pump pistons 56 are spaced from the internal surfaces of the longitudinal blind bores 68. Accordingly, the bore surfaces of the pump cylinders 26 and the external surfaces of the pump pistons 56 are substantially free of wear, only the seal assemblies 58 and the annular seals 74 slidingly engaging the pump pistons 56. In addition, it is apparent that either of the check valves 100 may be readily replaced by removal of the corresponding cover 84, that either of the annular seal rings 70 may be replaced by removal of the corresponding piston cylinder 26. Thus, those features of the pump 10 controlling the pumping of the fluid to be pumped may be readily serviced and/or replaced. Furthermore, the assemblies 58 are designed for long life and may be replaced with relative ease.

It will be noted that only a differential pressure of the actuating medium between the gas supply sink and the gas exhaust sink is required for operation of the pump 10. Of course, the gas discharged to the exhaust sink may be readily captured and marketed. Further, the annular seal ring 70 need not be tightly clamped between vertical flange 20 and the opposing end of the corresponding cylinder 26. Rather, it is only necessary that the O-ring seal 72 be reasonably compressed. Accordingly, the annular seal ring 70 may be radially shifted to compensate for any axial alignment deviations which would otherwise cause uneven radial pressures on the pump piston 56. Also, various check valves and seals may be readily serviced and/or repaired with minimum disassembly and the pump 10 is constructed in a manner such that there cannot be any contamination of the pump fluid by the pumping fluid.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A natural gas driven pump for glycol metering in a dehydrator system of a gas well, said pump including support structure defining a pair of spaced apart first mounting portions, a pair of cylinder heads removably stationarily supported from said mounting portions in predetermined positions thereof, an open ended drive cylinder extending between and removably mounted from said heads in keyed positions relative thereto, a pair of second mounting portions carried by said support structure spaced from and on remote sides of said heads, said heads including aligned central bores formed therethrough, a drive piston reciprocal in said drive cylinder and including oppositely axially projecting pump pistons projecting through said central bores, first radially fixed annular seal means removably mounted in the remote ends of said central bores, said second mounting portions including mounting flanges disposed generally normal to said cylinder and having through bores formed therein substantially coaxial with said drive cylinder and central bores, the remote ends of said through bores including counter bores in which second radially shiftable annular seal means are seated and through which said pump pistons are sealingly slidingly received, a pair of axially aligned pump cylinders including closed remote ends and open adjacent ends, said open adjacent ends beings removably mounted from said flanges over said counter bores closing said adjacent ends and removably securing said second annular seal means in adjusted radially shifted positions in said counter bores, said pump pistons being sealingly and slidingly received through said second annular seal means and projecting into the adjacent ends of said pumping cylinders, fluid pressure supply and discharge means operatively associated with each of the remote ends of said drive cylinder for supplying and discharging drive fluid under pressure to and from said drive cylinder ends and incorporating fluid pressure actuated reversing valve means for alternately inversely communicating said drive cylinder ends with a pressurized drive fluid source and a drive fluid discharge, each drive cylinder end including pressurized operating fluid supply means and drive piston engageable control means for supplying operating fluid under pressure to said valve means for alternate actuation thereof responsive to reciprocation of said drive piston in said drive cylinder, the remote ends of said pumping cylinders each including check valve equipped fluid inlet and outlet means for receiving and discharging fluid to be pumped.

2. The pump of claim 1 wherein said fluid pressure supply and pressurized operating fluid supply means comprise natural gas under pressure and said fluid to be pumped comprises ethylene glycol.

3. The pump of claim 1 wherein said second annular seal means includes axially facing O-ring seal means axially compressed against each of the corresponding adjacent ends of said pumping cylinders.

4. the pump of claim 3 wherein axial compression of said second annular seal means serves to frictionally retain radial positioning of said second seal means relative to the corresponding pumping cylinder.

5. The pump of claim 1 wherein said check valve equipped fluid inlet and outlet means is mounted on each of the remote ends of said pumping cylinders through the utilization of axially compressed annular seal means.

6. The pump of claim 5 wherein said check valve equipped fluid inlet and outlet means each are covered by through passage equipped cover means mounted thereon by means including an axially compressed O-ring extending about the corresponding through passage.

* * * * *